United States Patent [19]

Takeda

[11] Patent Number: 4,986,423

[45] Date of Patent: Jan. 22, 1991

[54] REGULAR-INTERNAL MAIL FEEDING APPARATUS

[75] Inventor: Kazuo Takeda, Kawasaki, Japan

[73] Assignee: Kabushiki Kaisha Toshiba, Kawasaki, Japan

[21] Appl. No.: 372,002

[22] Filed: Jun. 27, 1989

[30] Foreign Application Priority Data

Jun. 30, 1988 [JP] Japan ..... 63-163944

[51] Int. Cl.[5] ..... B07C 1/02

[52] U.S. Cl. ..... 209/540; 209/900; 209/934; 271/3.1; 414/788.8

[58] Field of Search ..... 209/540, 545, 584, 900, 209/583, 539, 934; 271/3.1, 298; 414/788.8, 797.6

[56] References Cited

U.S. PATENT DOCUMENTS

| | | | |
|---|---|---|---|
| 2,929,490 | 3/1960 | Stewart | 209/900 X |
| 3,029,944 | 4/1962 | Hirschfeld et al. | 209/900 X |
| 4,601,396 | 7/1986 | Pavie | 209/900 X |
| 4,615,446 | 10/1986 | Pavie | 209/900 X |
| 4,641,753 | 2/1987 | Tamada | 209/546 |
| 4,778,062 | 10/1988 | Pavie et al. | 209/900 X |

*Primary Examiner*—Donald T. Hajec

*Attorney, Agent, or Firm*—Finnegan, Henderson, Farabow, Garrett, and Dunner

[57] ABSTRACT

A regular-interval mail feeding apparatus is disposed between an automatic mail discriminating/postmarking apparatus and an automatic mail sorting apparatus, in an automatic mail handling system. When various kinds of mails are fed at irregularly intervals from the postmarking apparatus to the feeding apparatus, it temporaling stocks the mails at its stock and sends out the stocked mails one by one at a predetermined intervals to the sorting apparatus. When one kind of mails are fed at regular intervals, the feeding apparatus directly conveys the fed mails to the sorting apparatus without passing through the stock, by changing the mail conveying path in the feeding apparatus by using a gate member.

7 Claims, 3 Drawing Sheets

REGULAR-INTERNAL MAIL FEEDING APPARATUS

BACKGROUND OF THE INVENTION

1. Field of the Invention

The present invention relates to a regular-interval mail feeding apparatus used in an automatic mail handling system, in which a predetermined number of fed mails are temporarily stored, and are then sent out at regular intervals.

2. Description of the Related Art

The regular-interval mail feeding apparatus of this type is disposed between two other apparatuses in the conventional automatic mail handling system. One of these apparatuses, for example, automatically discriminates the kind of mails, arranges the mails in a predetermined direction, and postmarks them. The other apparatus, for example, automatically reads mail delivery-area codes (in United States, it is called as a ZIP code) from the postmarked mails, and sorts the mail in accordance with the read codes.

Various kinds of mails, such as sealed mails and postcards, are fed in layers to an inlet of the automatic mail discriminating/postmarking apparatus. At the inlet of this apparatus, the corresponding sides of the mails are arranged so as to be substantially parallel to one another. However, the extending directions of the four sides of the individual mails, which are based on the positions of stamps and postage-fee prints thereon, are not uniform in the inlet. The mail discriminating/postmarking apparatus automatically discriminates the kind of the mails fed to its inlet, and then change the posture of the mails so that all the sides of the mails are oriented as specified. Subsequently, the apparatus conveys the oriented mails to an automatic postmarking machine for postmarking the mails.

The time for the mail fed from the inlet of the automatic mail discriminating/postmarking apparatus to reach the automatic postmarking machine depends on the kind of the mail and the posture thereof at the inlet. The reason is that the mail varies in length depending on the kind thereof, and the time required for the orientation of the mail depends on the posture of the mail at the inlet. Accordingly, the intervals at which the postmarked mails are sent out from the automatic mail discriminating/postmarking apparatus are not uniform.

Thus, the postmarked mails may be fed at irregular intervals, directly from the automatic mail discriminating/postmarking apparatus to the automatic mail sorting apparatus, without passing through the regular-interval mail feeding apparatus. In such a case, when the mails are fed at shorter intervals than the aforesaid regular intervals, the sorting apparatus in sorting operation fails to catch up with the feed, thus entailing jamming of the mails. This results in lowering of the handling capability of the whole system.

The regular-interval mail feeding apparatus, which is intended to prevent the system's handling capability from lowering in a case that mails of various kinds are fed to the inlet of the automatic mail discriminating/postmarking apparatus, however, is subject to the following drawbacks.

If a large number of mails of a single kind are fed to the inlet in a manner such that all the sides of the individual mails are oriented as specified, the mails can be discharged at regular intervals from the automatic mail discriminating/postmarking apparatus, since they need not be discriminated in kind or reoriented. Even these postmarked mails, however, are fed to the automatic mail sorting apparatus only after being temporarily stored in the regular-interval mail feeding apparatus. In this case, the storage in the feeding apparatus has no significance, and the time for this storage lowers the handling capability of the whole aforesaid system. In this case, the temporary storage only increases the possibility of the jamming of mails.

The mails of a single kind include, for example, various mails of invitation or direct mails delivered to expected customers from companies or shops.

SUMMARY OF THE INVENTION

The present invention has been contrived in consideration of these circumstances, and its object is to provide a regular-interval mail feeding apparatus used in an automatic mail handling system, which ensures higher handling capability of the whole system when a large number of mails of a single kind are fed at regular intervals in a manner such that all the sides of the individual mails are oriented as specified, and lowers the possibility of the jamming of mails.

In order to achieve the above object, a regular-interval mail feeding apparatus according to the present invention comprises: first conveyor means for receiving mails intermittently fed one by one to one end thereof and conveying the mails toward the other end thereof; regular-interval mail feeding means, disposed at the other end of the first conveyor means, for storing a predetermined number of mails discharged from the other end of the first conveyor means and then sending out the stored mails one by one at regular intervals; second conveyor means for conveying the mails sent out from the regular interval mail feeding means to the outside; third conveyor means for conveying the mails fed to the one end thereof toward the other end, one end of the third conveyor means being connected to a portion between the two opposite ends of the first conveyor means, and the other end of the third conveyer means being connected to the second conveyor means; and diverging means, disposed at the junction between the first conveyor means and the one end of the third conveyor means, for selectively introducing the mails fed to the one end of the first conveyor means to the other end of the first conveyor means or the one end of the third conveyor means.

In the regular-interval mail feeding apparatus constructed in this manner, if mails of various kinds are intermittently fed one by one to the one end of the first conveyor means, the diverging means is controlled so as to direct the fed mails from the one end of the first conveyor means toward the regular-interval mail feeding means at the other end. If mails of a single kind are intermittently fed one by one to the one end of the first conveyor means, the diverging means is controlled so as to direct the fed mails from the one end of the first conveyor means toward the second conveyor means via the third conveyor means.

DETAILED DESCRIPTION OF THE PREFERRED EMBODIMENTS

One embodiment of the present invention will now be described in detail with reference to the accompanying drawings.

Figure 1:
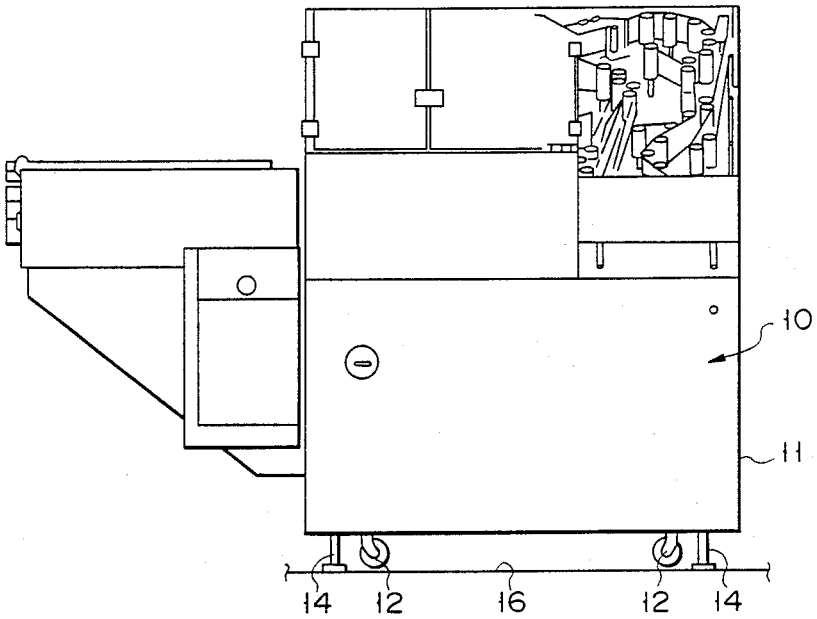
FIG. 1 is a side view schematically showing an outline of a regular-interval mail feeding apparatus according to an embodiment of the present invention.

FIG. 1 schematically shows an outline of regular-interval mail feeding apparatus 10 according to an embodiment of the invention. A plurality of casters 12 and support legs 14 are attached to the lower surface of sheath housing 11 according to this embodiment. Housing 11 can be freely moved to a desired position on floor surface 16, with the aid of casters 12, by being pushed in a desired direction with legs 14 lifted off surface 16. Housing 11 can be prevented from moving from the desired position on floor surface 16 by lowering legs 14 so that casters 12 are lifted off the floor surface.

In this embodiment, regular-interval mail feeding apparatus 10 is disposed between two other apparatuses (not shown in FIG. 1) in an automatic mail handling system. One of these apparatuses automatically discriminates the kind of mails, arranges the mails in a predetermined direction, and postmarks them. The other apparatus automatically reads mail delivery area codes (in United States, it is called as a ZIP code) from the postmarked mails, and sorts the mails in accordance with the read codes. In FIG. 1, the automatic mail discriminating/ postmarking apparatus and the automatic mail sorting apparatus are located at the right and leftsides of apparatus 10, respectively.

Figure 2:
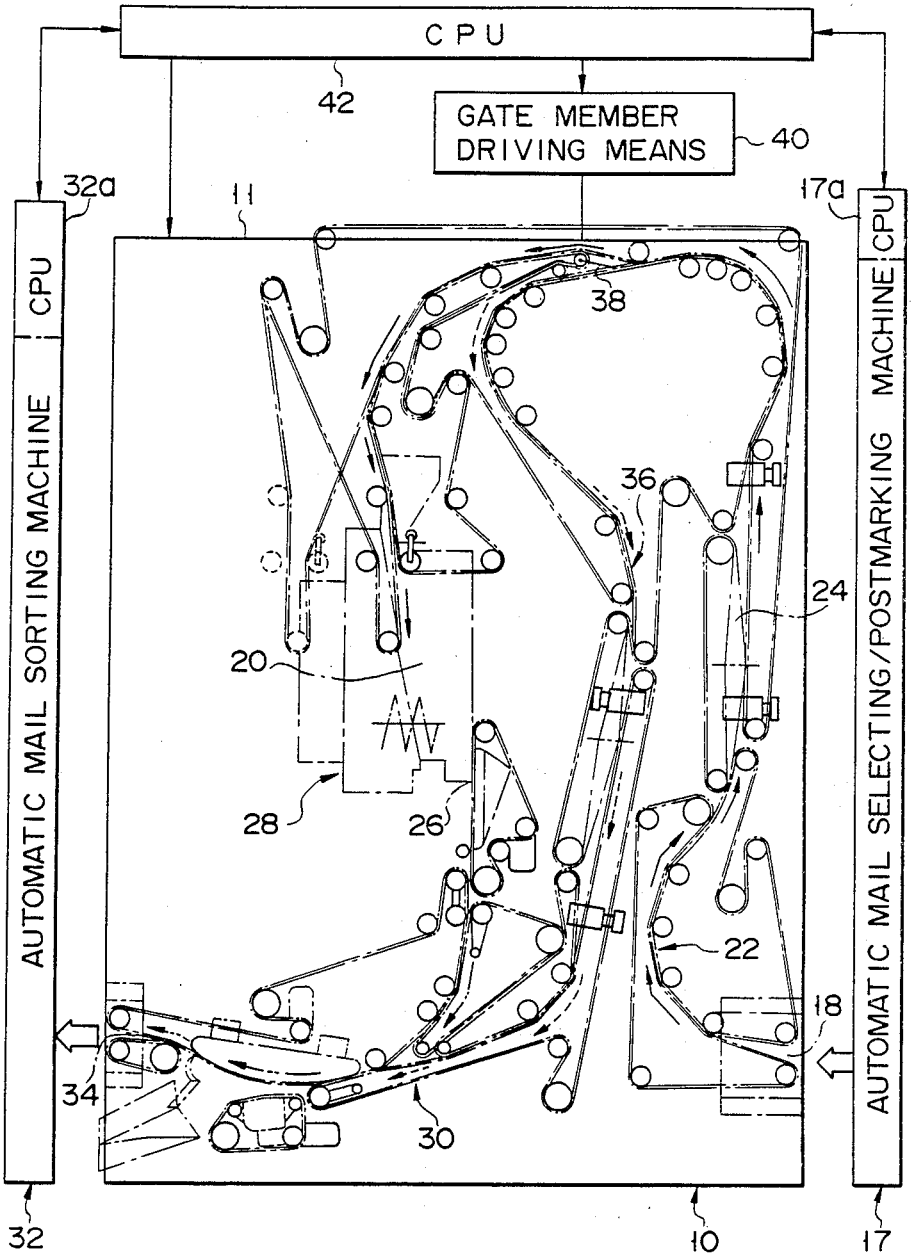
FIG. 2 is a view schematically showing a plural mail conveying means in the apparatus of FIG. 1.

As shown in FIG. 2, inlet 18 opens at the lower portion of the right-hand side surface of sheath housing 11 which faces automatic mail discriminating/postmarking apparatus 17. Postmarked mails are intermittently fed one by one from apparatus 17 to inlet 18. Mail stacker 20 for temporarily storing a predetermined number of postmarked mails is disposed substantially in the center of housing 11. The postmarked mails fed to inlet 18 are conveyed to stacker 20 by first conveyor means 22.

In this embodiment, first conveyor means 22 includes a plurality of belts, guide rollers for guiding the belts, and driving rollers for driving the belts. A first conveying path, which is formed by conveyor means 22, extends upward from inlet 18 along the inner surface of the right-hand side wall of sheath housing 11, then bends along the upper end of the housing, and then extends downward or toward an inlet of mail stacker 20. Thus, the first conveying path is substantially inverted-L-shaped.

As the driving rollers are driven by means of a motor (not shown), first conveyor means 22 conveys postmarked mails from inlet 18 to mail stacker 20. Means 22 includes aligning portion 24 at the upwardly extending section of the first conveying path. Aligning portion 24 serves to align each postmarked mail from inlet 18 so that the longitudinal center line of the mail is in line with the longitudinal direction of the first conveying path. In FIG. 2, the course of the postmarked mails in the first conveying path is indicated by full-line arrows.

Regular-interval mail sending-out mechanism 26, which sends out the predetermined number of postmarked mails one by one from stacker 20 at regular intervals, is mounted in mail stacker 20. Stocker 20, with mechanism 26 thereon, constitutes regular-interval mail feeding means 28.

The postmarked mails from mail sending-out mechanism 26 of regular-interval mail feeding means 28 are conveyed, by means of second conveyor means 30, to outlet 34 formed at the lower portion of the left-hand side surface of sheath housing 11 which faces automatic mail sorting apparatus 32. Outlet 34 is connected to an inlet of apparatus 32, the postmarked mails sent out to outlet 34 are fed at regular intervals to the inlet of apparatus 32.

In this embodiment, second conveyor means 30 also includes a plurality of belts, guide rollers for guiding the belts, and driving rollers for driving the belts. A second conveying path, which is formed by conveyor means 30, is substantially J-shaped, extending from mail sending-out mechanism 26 of regular-interval mail feeding means 28 to outlet 34.

When regular-interval mail sending-out mechanism 26 is switched on, the driving rollers of second conveyor means 30 are driven by means of a motor (not shown). Thereupon, the postmarked mails sent out at regular intervals from mechanism 26 are fed to the inlet of automatic mail sorting apparatus 32 via outlet 34. In FIG. 2, the course of the postmarked mails in the second conveying path is indicated by two-dot chain-line arrows.

The first conveying path, formed by first conveyor means 22, is connected, between aligning portion 24 and regular-interval mail feeding means 28, to one end of a third conveying path, which is formed by third conveyor means 36. Inside sheath housing 11, the third conveying path extends downward, and its other end is connected to the second conveying path formed by second conveyor means 30.

In this embodiment, third conveyor means 36 also includes a plurality of belts, guide rollers for guiding the belts, and driving rollers for driving the belts. As the driving rollers are driven by means of a motor (not shown) when the postmarked mails are introduced from the first conveying path of first conveyor means 22, third conveyor means 36 conveys the mails directly to the second conveying path of second conveyor means 30 so that the mails by-pass regular-interval mail feeding means 28 having mail stacker 20.

Since second conveyor means 30 is switched on in association with third conveyor means 36, the postmarked mails, sent out into the second conveying path of second conveyor means 30 by third conveyor means 36, are fed to the inlet of automatic mail sorting apparatus 32 via outlet 34 by second conveyor means 30 In FIG. 2, the course of the postmarked mails in the third conveying path is indicated by broken-line arrows.

Gate member 38, for use as diverging means, is located at the intersection of the first and third conveying paths of first and third conveyor means 24 and 36. Member 38 serves selectively to introduce the postmarked mails from the first conveying path into mail stacker 20 of regular-interval mail feeding means 28 located at the inner end of the first conveying path, or into the third conveying path. The gate member 38 is selectively driven by conventional drive means 40, such as rotary or linear solenoid drive means, pneumatic cylinder, etc., so that it is moved between first and second positions. In the first position (see FIG. 2), the diverging portion of the first conveying path is opened, and the inlet of the third conveying path is closed. In the second position, the diverging portion of the first conveying path is closed, and the inlet of the third conveying path is opened.

Drive means 40 is connected to central processing unit (CPU) 42 of regular-interval mail feeding apparatus 10. CPU 42 is connected to CPU 17*a* of automatic mail discriminating/postmarking apparatus 17 and CPU 32*a* of automatic mail sorting apparatus 32.

Figure 3:
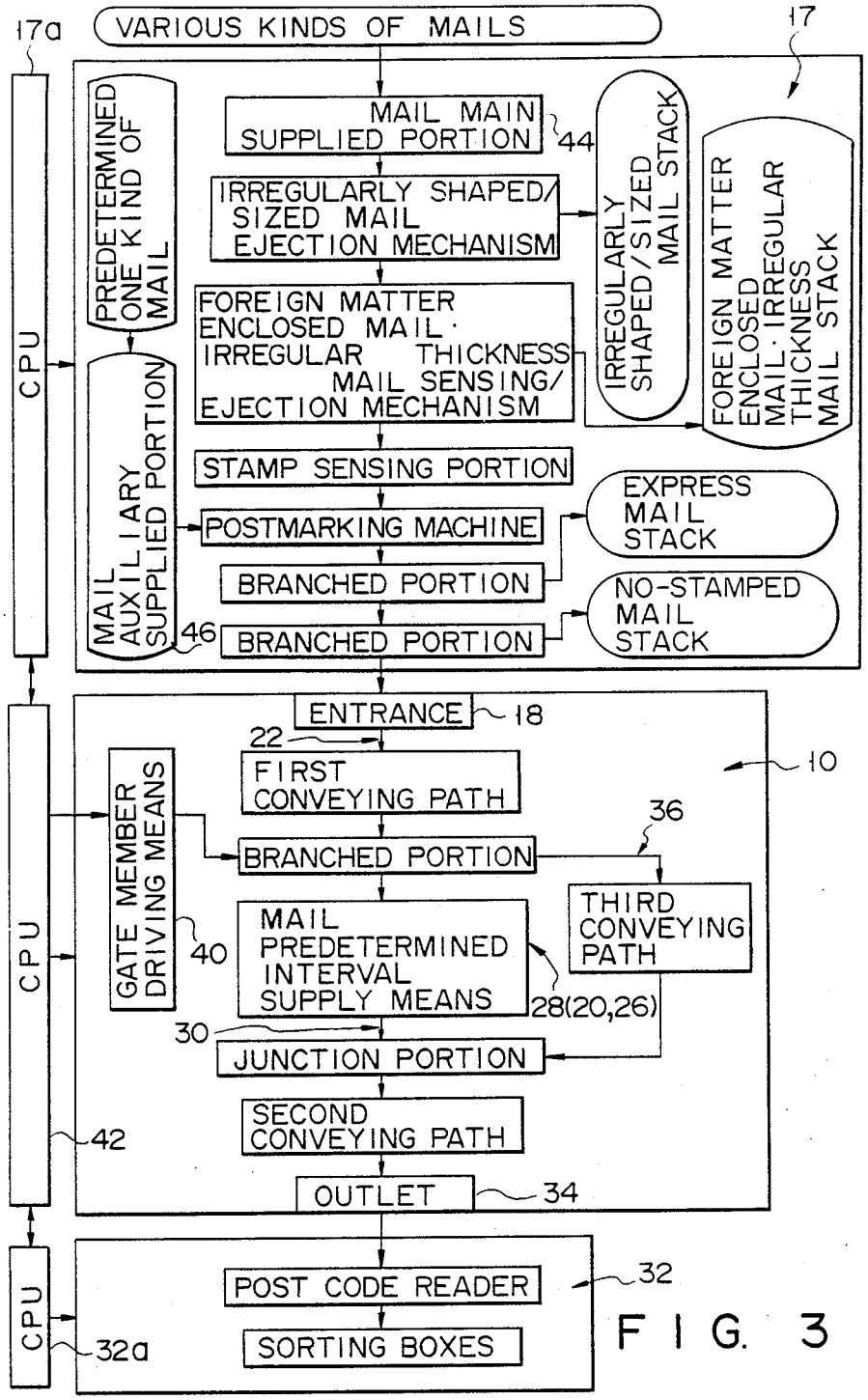
FIG. 3 is a diagram schematically showing a flow of mail handling from an automatic mail discriminating/ postmarking apparatus through the regular-interval mail feeding apparatus of FIG. 1 to an automatic mail sorting apparatus, in an automatic mail handling system in which the regular-interval mail feeding apparatus is incorporated.

FIG. 3 schematically shows processes of handling the mail in automatic mail discriminating/postmarking apparatus 17, regular-interval mail feeding apparatus 10, and automatic mail sorting apparatus 32, in the automatic mail handling system.

Automatic mail discriminating/postmarking apparatus 17 is provided with main mail receiving section 44, to which mails of various kinds are fed, and auxiliary mail receiving section 46, to which mails of one specific kind are fed.

If mails of various kinds are fed in layers to main mail receiving section 44 in a manner such that their respective four sides are aligned in extending direction, they are sent out one by one from section 44 to an irregularly shaped/sized mail (a nonstandardized mail) ejection mechanism. The positions of stamps and postage-fee prints on the mails in main mail receiving section 44 are random. The ejection mechanism detects and ejects nonstandardized letter mails toward an irregularly shaped/sized mail stack when they are sent out from main mail receiving section 44. When regularly shaped/sized mails (standardized mails) are sent out from section 44, the ejection mechanism send out them to a foreign matter enclosed mail irregular thickness mail sensing/ejection mechanism. If the foreign matter enclosed or thick mail sensing/ ejection mechanism detects that any of the standardized mails from the nonstandardized mail ejection mechanism encloses a foreign matter or is irregularly thick, it ejects the foreign matter enclosed or irregular thickness mails toward a foreign matter enclosed or irregular thickness mail stack, and send out the other standardized mails to a stamp sensing portion. The stamp sensing portion detects the positions of the stamps and the postage-fee prints on the standardized mails, fed from the foreign matter enclosed or thick mail ensing/ejection mechanism, changes the posture of the standardized mails, as required, so that the stamps or the postage-fee prints on the mails are oriented to a predetermined direction in a conveying path, with respect to the conveying direction of the mails, and then sends out the standardized mails to a postmarking machine. If an indication of express delivery is detected at the stamp sensing portion, the standardized mails postmarked by the postmarking machine and advanced toward the outlet of automatic mail discriminating/ postmarking apparatus 17 are ejected and conveyed to an express-mail stack before it is reached at the outlet. If the stamp sensing portion cannot detect the stamp and the postage-fee print on an any one of the standardized mails, the postmarking machine never postmarks the no-stamped or the postage-fee-print no attached mail, and the unpostmarked mail is ejected toward a no-stamped mail stack on its way to the outlet.

In the aforesaid case, the postmarked standardized mails are sent out at random intervals from the outlet of automatic mail discriminating/ postmarking apparatus 17 to inlet 18 of regular-interval mail feeding apparatus 10. The intervals are irregular because the time required for the stamp detection or change of posture varies depending on the kind and posture of the mail fed to main mail receiving section 44.

If mails of various kinds are fed to main mail receiving section 44, CPU 17*a* of automatic mail discriminating/postmarking apparatus 17 transmits a diverse-mail feed signal to CPU 42 of regular-interval mail feeding apparatus 10. Thereupon, CPU 42 controls gate member drive means 40 in apparatus 10 to move gate member 38 in the first position, as shown in FIG. 2 (where the diverging portion of the first conveying path is opened, and the inlet of the third conveying path is closed).

The postmarked standardized mails fed to inlet 18 of regular-interval mail feeding apparatus 10 are conveyed to mail stacker 20 of regular-interval mail feeding means 28 by first conveyor means 22, and are stored in the stacker 20. When the number of the postmarked standardized mails in stacker 20 attains a predetermined value, regular-interval mail sending out mechanism 26 of feeding means 28 sends out these mails at regular intervals to second conveyor means 30. Conveyor means 30 conveys the postmarked standardized mails to outlet 34 of regular-interval mail feeding apparatus 10, whereupon the mails are fed at predetermined intervals to the inlet of automatic mail sorting apparatus 32.

Automatic mail sorting apparatus 32 reads mail-delivery-area codes from the postmarked standardized mails by means of a code reader, and moves the mails to sorting boxes corresponding to the read codes.

If mails of one specific kind, e.g., direct mail, are fed in layers to auxiliary mail receiving section 46 of automatic mail discriminating/postmarking apparatus 17 in a manner such that their respective four sides are aligned in extending direction, they are sent out one by one at regular intervals from section 46 to the postmarking machine. Stamps and postage fee prints on the mails in auxiliary mail receiving section 46 are aligned beforehand in predetermined positions. The postmarked mails, postmarked by the postmarking machine and conveyed toward the outlet of automatic mail discriminating/postmarking apparatus 17, are fed therefrom at regular intervals to inlet 18 of regular-interval mail feeding apparatus 10.

If a large number of mails of the specific kind are fed to auxiliary mail receiving section 46, CPU 17*a* of automatic mail discriminating/postmarking apparatus 17 transmits a homogeneous mail feed signal to CPU 42 of regular-interval mail feeding apparatus 10. Thereupon, CPU 42 controls gate-member drive means 40 in apparatus 10 to move gate member 38 in the second position (where the diverging portion of the first conveying path is closed, and the inlet of the third conveying path is opened).

The postmarked mails fed to inlet 18 of regular-interval mail feeding apparatus 10 are introduced into the third conveying path, formed by third conveyor means 36, in the middle of the first conveying path. The third conveying path allows the postmarked standardized mails to be fed at regular intervals to second conveyor means 30 without passing through regular-interval mail feeding means 28. Conveyor means 30 conveys the postmarked mails to outlet 34 of regular-interval mail feeding apparatus 10, whereupon the mails are fed at predetermined intervals to the inlet of automatic mail sorting apparatus 32.

In this case, automatic mail sorting apparatus 32 operates in the same manner as in the case where the mails of various kinds are fed to main mail receiving section 44 of automatic mail discriminating/postmarking apparatus 17.

What is claimed is:

1. A regular-interval mail feeding apparatus having an inlet and an outlet, comprising:

first conveyor means for receiving mails intermittently fed one by one to a first end thereof, and conveying the mails toward a second end thereof;

storing means disposed at the second end of the first conveyor means for storing a predetermined number of mails discharged from the second end of the first conveyor means, and sending out the stored mails one by one at regular-intervals;

second conveyor means for conveying the mails sent out from the storing means to the outlet of the regular-interval mail feeding apparatus;

third conveyor means for conveying the mails fed to a first end thereof toward a second end thereof, the first end of the third conveyor means being connected to the first conveyor means between the first and second opposite ends, and the second end of the third conveyor means being connected to the second conveyor means;

diverging means for selectively introducing the mails fed to the first end of the first conveyor means to the second end of the first conveyor means or to the first end of the third conveyor means; and control means for controlling the diverging means so that the mails fed to the first end of the first conveyor means are introduced to the second end of the first conveyor means when the mails are supplied one by one to the first end of the first conveyor means at random intervals, and the mails fed to the first end of the first conveyor means are introduced to the first end of the third conveyor means when the mails are supplied one by one to the first end of the first conveyor means at regular intervals.

2. The regular-interval mail feeding apparatus according to claim 1, wherein said first, second, and third conveyor means each include a plurality of guide rollers and guide belts guided thereby.

3. The regular-interval mail feeding apparatus according to claim 1, wherein:

the diverging means includes a gate member movable between a first position in which the gate member opens a first conveying path formed by the first conveyor means and closes a third conveying path formed by the third conveyor means, and a second position in which the gate member closes the first conveying path and opens the third conveying path; and the control means controls the gate member to move it to the first position when the mails are supplied one by one to the first end of the first conveyor means at random intervals, and to move it to the second position when the mails are supplied one by one to the first end of the first conveyor means at regular intervals.

4. The regular-interval mail feeding apparatus according to claim 3, wherein said regular-interval mail feeding apparatus is disposed between an automatic mail discriminating/postmarking apparatus and an automatic mail sorting apparatus, in an automatic mail handling system, said automatic mail discriminating/postmarking apparatus serving automatically to discriminate the kinds of mails, changes the posture of mails in a predetermined direction, and postmarks the mails, and said automatic mail sorting apparatus serving automatically to read mail-delivery area codes from the postmarked mails and sort the mails in accordance with the read codes, said automatic mail discriminating/postmarking apparatus having a first inlet fed with mails of various kinds and a second inlet fed with mails of one specific kind; and said gate member of said diverging means of the regular-interval mail feeding apparatus is adapted to be moved in the first position when the mails of various kinds are fed to the first inlet of the automatic mail discriminating/postmarking apparatus, and to be moved in the second position when the mails of the specific kind are fed to the second inlet.

5. A regular-interval mail feeding apparatus which is disposed between an automatic mail discriminating/postmarking apparatus and an automatic mail sorting apparatus, in an automatic mail handling system, said automatic mail discriminating/postmarking apparatus serving automatically to discriminate the kinds of mails, change the posture of mails in a predetermined direction, and postmark the mails, and said automatic mail sorting apparatus serving automatically to read mail-delivery area codes from the postmarked mails and sort the mails in accordance with the read codes, and which is adapted to temporarily store a predetermined number of postmarked mails fed from the automatic mail discriminating/postmarking apparatus and then send out the stored mails at regular intervals; and wherein said automatic mail discriminating/postmarking apparatus has a first inlet fed with mails of various kinds and a second inlet fed with mails of one specific kind, said regular-interval mail feeding apparatus comprising:

first conveyor means for receiving the mails intermittently fed one by one from the automatic mail discriminating/postmarking apparatus to one end thereof and conveying the mails toward the other end thereof, including a junction portion between the two opposite ends thereof;

regular-interval mail feeding means, disposed at the other end of the first conveyor means, for storing a predetermined number of mails discharged from the other end of the first conveyor means and sending out the stored mails one by one at regular intervals;

second conveyor means for conveying the mails sent out from the regular-interval mail feeding means to the automatic mail sorting apparatus;

third conveyor means for conveying the mails fed to the one end thereof toward the other end, one end of said third conveyor means being connected at the junction portion between the two opposite ends of the first conveyor means, and the other end of said third conveyor means being connected to the second conveyor means; and diverging means, disposed at the junction portion between the first conveyor means and the one end of the third conveyor means, for selectively introducing the mails fed to the one end of the first conveyor means to the other end of the first conveyor means or the one end of the third conveyor means.

said diverging means including a gate member movable between a first position, where a first conveying path formed by the first conveyor means is opened at the junction portion, and an inlet of a third conveying path formed by the third conveyor means is closed, and a second position, where the first conveying path is closed at the junction portion, and the inlet of the third conveying path is opened, said gate member being adapted to be moved into the first position when the mails of the various kinds are fed to the first inlet of the automatic mail discriminating/postmarking apparatus, and to be moved into the second position when the mails of the specific kind are fed to the second inlet.

6. A regular-interval mail feeding apparatus having an inlet and an outlet, comprising:

first conveyor means for receiving mails intermittently fed one by one to a first end thereof, and conveying the mails toward a second end thereof;

storing means disposed at the second end of the first conveyor means for storing a predetermined number of mails discharged from the second end of the first conveyor means, and sending out the stored mails one by one at regular intervals;

second conveyor means for conveying the mails sent out from the storing means to the outlet of the regular-interval mail feeding apparatus;

third conveyor means for conveying the mails fed to a first end thereof toward a second end thereof, the first end of the third conveyor means being connected to the first conveyor means between the first and second opposite ends, and the second end of the third conveyor means being connected to the second conveyor means;

a gate member movable between a first position in which the gate member opens a first conveying path formed by said first conveyor means and closes a third conveyor path formed by said third conveyor means at the first end of the third conveyor means, and a second position in which the gate member closes the first conveying path and opens the third conveying path; and means for electrically controlling the gate member to move it to the first position when the mails are supplied one by one to the first end of the first conveyor means at random intervals, and to move it to the second position when the mails are supplied one by one to the first end of the first conveyor means at regular intervals.

7. A regular-interval mail feeding apparatus having an inlet and an outlet, the apparatus to be used in combination with a mail supply apparatus which has first stacking means for stacking various kinds of mails and supplying them one by one to the inlet of the regular-interval mail feeding apparatus, and second stacking means for stacking one kind of mails in a predetermined posture and supplying them one by one to the inlet of the regular interval mail feeding apparatus, the intervals of the supplying of the various kinds of mails supplied from the first stacking means to the inlet of the regular-interval mail feeding apparatus being random, and the intervals of the supplying of one kind of mails supplied from the second stacking means to the inlet of the regular-interval mail feeding apparatus being regular, the regular-interval mail feeding apparatus comprising:

first conveyor means for receiving mails intermittently fed through the inlet of the regular-interval mail feeding apparatus one by one to a first end thereof, and conveying the mails toward a second end thereof;

storing means, disposed at the second end of the first conveyor means for storing a predetermined number of mails discharged from the second end of the first conveyor means, and sending out the stored mails one by one at regular-intervals;

second conveyor means for conveying the mails sent out from the storing means to the outlet of the regular-interval mail feeding apparatus;

third conveyor means for conveying the mails fed to a first end thereof toward a second end thereof, the first end of the third conveyor means being connected to the first conveyor means between the first and second opposite ends of the first conveyor means, and the second end of the third conveyor means being connected to the second conveyor means;

a gate member movable between a first position in which the gate member opens a first conveying path formed by said first conveyor means and closes a third conveying path formed by said third conveyor means, and a second position in which the gate member closes the first conveying path and opens the third conveying path; and control means, electrically connected to the first stacking means and second stacking means of the mail supply apparatus, for receiving a first control signal from the first stacking means and for receiving a second control signal from the second stacking means, said control means electrically controlling the gate member to move it to the first position when the control means receives the first control signal, and to move it to the second position when the control means receives the second control signal.

* * * * *